United States Patent [19]

Juergens

[11] Patent Number: 5,035,337

[45] Date of Patent: Jul. 30, 1991

[54] MOBILE CRANE WITH COUNTERWEIGHT AND AUXILIARY COUNTERWEIGHT

[75] Inventor: Dieter C. Juergens, Mathis, Tex.

[73] Assignee: Deep South Crane & Rigging Co., Baton Rouge, La.

[21] Appl. No.: 581,876

[22] Filed: Sep. 13, 1990

[51] Int. Cl.[5] ..... B66C 23/76

[52] U.S. Cl. ..... 212/196; 212/195

[58] Field of Search ..... 212/195, 196, 197, 198, 212/178

[56] References Cited

U.S. PATENT DOCUMENTS

| | | | |
|---|---|---|---|
| 2,036,386 | 4/1936 | Andersen | 212/195 |
| 4,081,081 | 3/1978 | Morrow et al. | 212/195 |
| 4,540,097 | 9/1985 | Wadsworth et al. | 212/196 |
| 4,579,234 | 4/1986 | Delago et al. | 212/195 |

*Primary Examiner*—Sherman Basinger
*Assistant Examiner*—Thomas J. Brahan
*Attorney, Agent, or Firm*—Nilles & Nilles

[57] ABSTRACT

The disclosed mobile crane for lifting heavy loads has a base on which a platform is rotatable on a vertical axis, a boom connected to the platform to swing in a plane containing the vertical axis, and a load line trained over the top of the boom. A spar substantially shorter than the boom has a spar connection to the platform, behind the boom connection, for swinging in the same plane. A rod-like link has at its ends pivotal connections respectively to the platform and to the spar, both spaced from the spar connection and one of which is a pin-and-slot connection defining upper and lower limits of a range of swing of the spar through which it is inclined upward and rearward from the spar connection. A tension line is connected between the rear end of the spar and the upper end of the boom. Counterweights on the spar offset tilting forces due to the weight of the forwardly inclined boom itself and loads supported by it. Winches for hoisting and luffing are preferably mounted on the spar for further counterweighting.

7 Claims, 5 Drawing Sheets

MOBILE CRANE WITH COUNTERWEIGHT AND AUXILIARY COUNTERWEIGHT

FIELD OF THE INVENTION

This invention relates to mobile hoisting cranes and is more specifically concerned with a mobile crane that has a counterweight which is normally ground supported but which is lifted by the crane at the same time that the crane applies lifting force to a heavy load to offset the tilting force that the load imposes upon the crane.

BACKGROUND OF THE INVENTION

Cranes of the general type to which this invention relates are disclosed, for example, in U.S. Pat. Nos. 3,842,984; 4,258,852 and 4,540,097.

Such a crane has an earthborne base that is usually mounted on wheels or crawler treads, and has a platform mounted on the base for rotation about a vertical axis. Pivoted to the platform for swinging substantially in a plane that contains the vertical axis is a boom that normally extends up from the base at a forward inclination to that axis. A load line passing over the upper end of the boom has one end depending from the boom to be connectable with a load and has its opposite end connected with a winch on the platform.

Conventionally the platform has had a tail-like rearwardly projecting portion, to which was attached a main counterweight that offset the forward tilting force exerted by the boom and by any light to moderately heavy load the crane was hoisting.

When such a crane was used for lifting a very heavy load, it was often provided with a mast that had a pivot connection with the platform, which connection was behind the boom connection and allowed the mast to swing relative to the platform in substantially the same plane that contained the swinging of the boom. A tension line connected between the upper ends of the boom and the mast tended to make them swing in unison and normally positioned the mast to project up from the platform at a rearward inclination to the vertical axis. A line attached to the top of the mast was connected with an auxiliary counterweight that was normally ground-supported. When a heavy load was being hoisted, the boom would swing forwardly and downwardly in reaction to the lift force exerted on the load, and through the tension line the mast was correspondingly swung forwardly and upwardly. The swinging of the mast lifted the auxiliary counterweight off of the ground, so that the full weight of the auxiliary counterweight, in addition to that of the main counterweight, was applied to offsetting the tilting force that the load exerted upon the boom. A gantry structure fixed on the rear part of the platform had a lost motion connection with the mast that defined the forward limit of swinging motion of the boom relative to the platform.

For transport from one job site to another, a crane of the type here under consideration is adapted to be partially disassembled into units that comply with size and weight limitations prescribed for highway vehicles. Hence a mobile crane should be as compact, as light, and as easy to assemble and disassemble as is consistent with its hoisting capacity. It is also desirable that such a crane have the smallest possible tail swing, that is, that its upper structure, including counterweights, project the least possible distance behind the vertical axis so that it can operate in a relatively restricted space without interference from obstacles around its rear.

Apparently it has not heretofore been obvious that the tall, bulky and relatively heavy mast considered necessary for equipping a mobile crane to hoist relatively heavy loads could be replaced for all but the very heaviest loads with a lower, lighter and more compact structure that would reduce tail swing, would be easier to assemble and disassemble, and would be more convenient and economical to transport.

SUMMARY OF THE INVENTION

The general object of this invention is to provide an improved mobile crane of the type that has a normally ground-supported auxiliary counterweight which is lifted as the crane applies hoisting force to a very heavy load, and particularly to provide such a crane with an upper structure which, as compared to the heretofore conventional upper structures of such cranes, is lighter, more compact and less expensive, provides a smaller tail swing, and is more easily assembled and disassembled for converting the crane between its transport and its operating conditions.

A more specific object of the invention is to provide a novel arrangement for the upper structure of a mobile crane of the character described, whereby the mast heretofore used for lifting relative heavy loads can be eliminated for most hoisting jobs but can be readily installed, without increasing the tail swing, where the requirement for lifting an exceptionally heavy load would make the mast desirable for decreasing the forces in the boom and boom suspension.

It is another object of this invention to eliminate the need for a gantry structure on the platform of such a crane while providing a more compact and inexpensive means for obtaining the needed limitation upon forward swinging of its boom.

Another and more specific object of the invention is to provide an unusually versatile mobile crane that can be readily adapted to the requirements of each of a wide variety of hoisting tasks by interchange of a few simple and relatively inexpensive modular parts that can be readily installed and removed and are light and compact for ease of transport.

These and other objects of the invention that will appear as the description proceeds are achieved in the mobile crane of this invention, which is capable of lifting very heavy loads and which is of the type that comprises a platform rotatable on a base about a vertical axis, an elongated boom having upper and lower ends, a boom connection between the platform and the boom, at the lower end of the latter, whereby the boom is confined to swinging relative to the platform substantially in a plane containing said vertical axis, and a load line trained over the upper end of the boom and having a free end portion connectable with a load to be lifted. The crane of this invention is characterized by an elongated spar which is substantially shorter than the boom and which has opposite front and rear ends. At its front end this spar has a spar connection with the platform which is spaced in a rearward direction along the platform from said boom connection and which confines the spar to swinging motion substantially in said plane relative to the platform. The crane is further characterized by means providing a lost motion connection between the platform and the spar that defines opposite upper and lower limits of a range of swinging motion of the spar through which the rear end of the spar projects rearwardly beyond the platform. A counterweight is so connected to the rear end of the spar as to be supported by the ground when the spar is at the lower limit of its swinging motion but to be otherwise pendent from the spar and supported by it. A tension connection between the upper end of the boom and the rear end of the spar maintains a constant distance between those ends, which distance is such that, throughout said range of swinging motion of the spar, the boom is maintained at a forward and upward inclination to the vertical axis.

In a preferred embodiment of the invention, a winch to which the opposite end of the load line is connected is mounted on the spar.

It is also preferred that a second counterweight be attached to the spar, a short distance inward from its rear end, to be wholly supported by the spar at substantially all times when the crane is in operation.

The means providing a lost motion connection between the platform and the spar preferably comprises an elongated link having at one of its ends a pivot connection with the platform and having at its opposite end a pivot connection with the spar, both of said pivot connections being spaced from said spar connection and providing for swinging of the link substantially in said plane relative to both the platform and the spar, and one of said pivot connections being a pin-and-slot connection wherein the ends of the slot define said upper and lower limits of the range of swinging motion of the spar.

BRIEF DESCRIPTION OF THE DRAWINGS

In the accompanying drawings, which illustrate what is now regarded as a preferred embodiment of the invention.

DETAILED DESCRIPTION OF THE PREFERRED EMBODIMENT OF THE INVENTION

Figure 1:
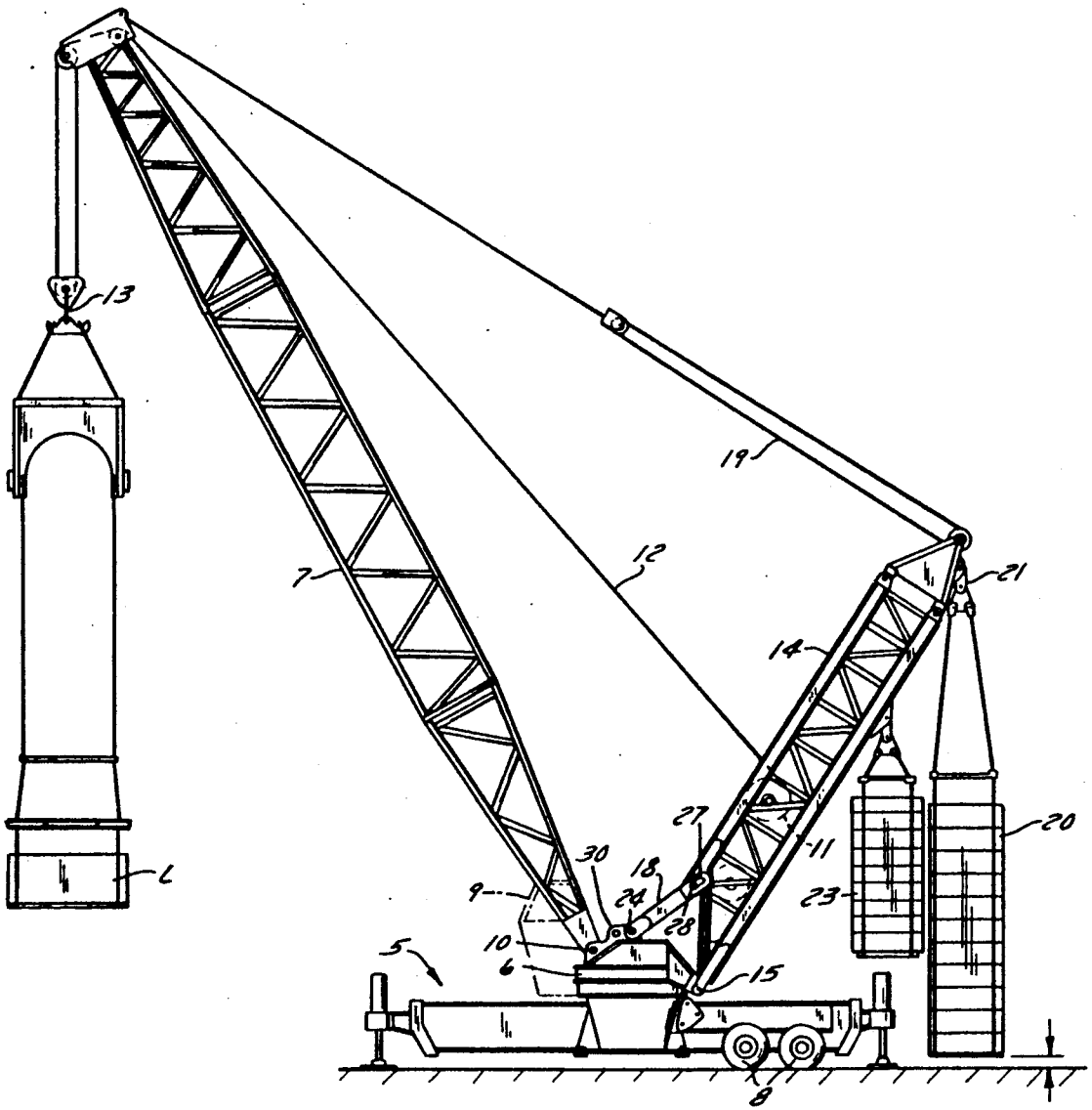
FIG. 1 is a view in side elevation of a mobile hoisting crane embodying the principles of this invention, shown in its heavily loaded condition in which the auxiliary counterweight is lifted to offset the tilting force due to the load.
Figure 2:
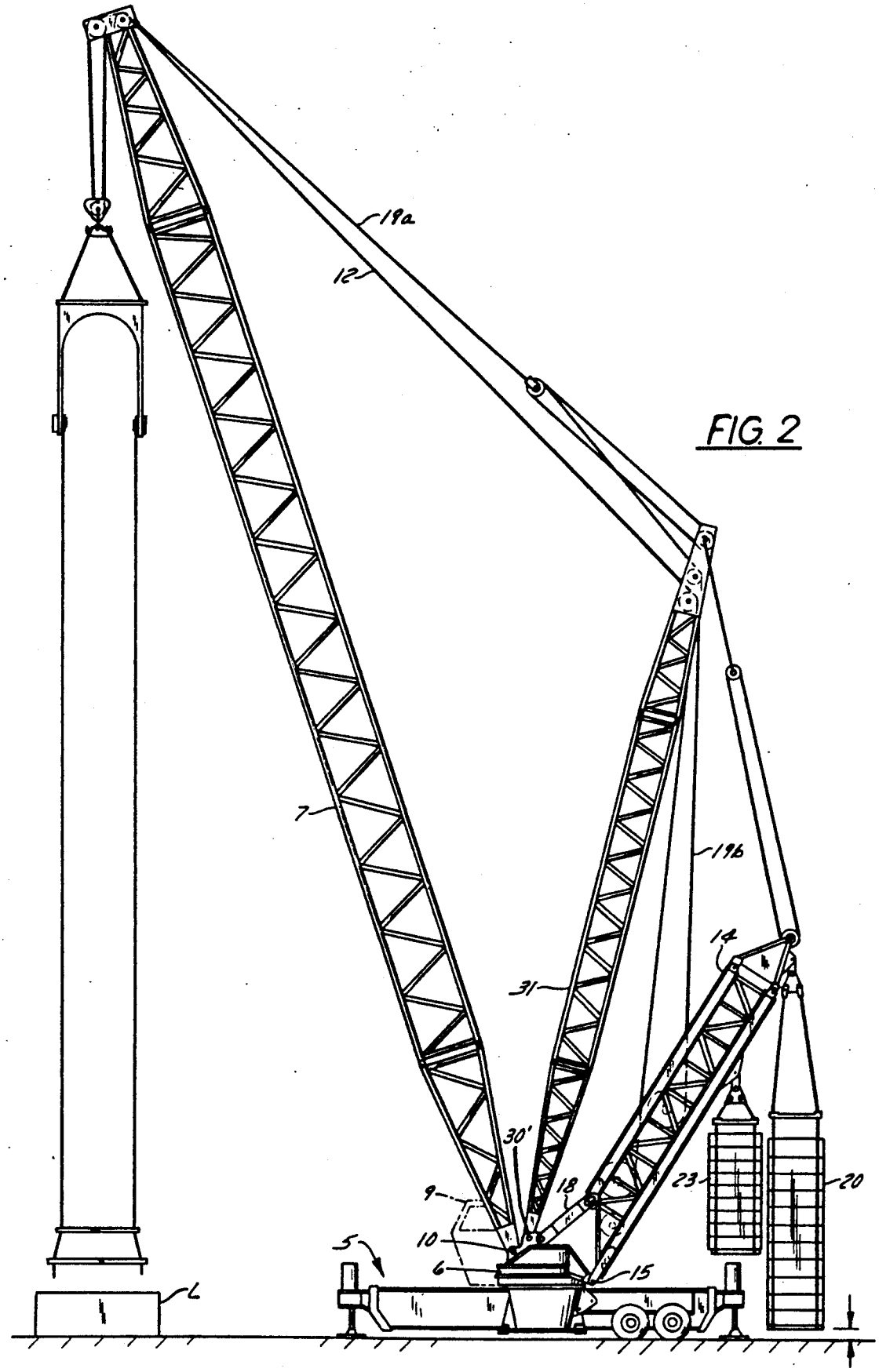
FIG. 2 is a view generally similar to FIG. 1 but showing the crane with a mast installed thereon.

A hoisting crane embodying the principles of this invention comprises a ground-supported base 5 on which there is a platform 6 that is rotatable about a vertical slewing axis; and the platform 6, in turn, supports upper structure that includes an elongated, generally upwardly projecting boom 7. In this case the base 5 is illustrated as being in the nature of a flat-bed trailer that is mounted on wheels 8 for highway transport, but the base could obviously comprise, for example, a self-propelled vehicle mounted on crawler treads.

The boom 7 has at its lower end a connection 10 with the platform that defines a horizontal axis which is spaced a short distance forwardly from the vertical axis and about which the boom swings substantially in a plane that contains the vertical axis. From a winch 11 that is carried by the platform as described below there extends a load line 12 which is trained over the top of the boom and which has a depending free end 13 that is connectable to loads to be hoisted.

An operator's cab 9 may be mounted on the platform, spaced to one side of the plane in which the boom swings.

In the crane of this invention the upper structure includes a spar 14 which is substantially shorter than the boom and which has opposite front and rear ends. At its front end the spar 14 has a connection 15 with the platform, about which the spar is swingable substantially in the plane wherein the boom swings. The swinging axis defined by the spar connection 15 is parallel to the horizontal axis defined by the boom connection 10, is spaced to the rear of that boom connection axis, and is preferably at a somewhat lower level.

A rigid link 18 that comprises a lost motion connection between the spar 14 and the platform 6, as described below, defines upper and lower limits of a range of swinging motion of the spar, and through that range the spar always has an upward and rearward inclination to the vertical axis and is always at such an angle to that axis that a vertical line through its rear end will fall outside the limits of the platform and the base in every position of platform rotation. The rear end of the spar 14 is connected with the top end of the boom 7 by means of a tension line 19 which maintains a fixed distance between those ends and constrains the spar and the boom to swing in unison. The boom therefore has forward and rearward limits of its swinging motion that correspond to the upper and lower limits of swinging motion of the spar. The length of the tension line 19 is so adjusted that the boom is maintained at a forward and upward inclination to the vertical axis through the range of its swinging motion.

Attached to the spar at some distance forward from its rear end is a main counterweight 23 that is normally pendent from the spar at all times that the crane is in operation. The force that this main counterweight imposes upon the boom 7 through the tension connection 19 tends to offset the tilting force that the forwardly and upwardly inclined boom at all times imposes upon the crane base.

When a very heavy load is to be lifted, an auxiliary counterweight 20 is connected to the rear end of the spar by means of a line 21. The line 21 is of such length that the auxiliary counterweight is supported by the ground when the spar is at the lower limit of its swinging motion but is lifted off of the ground as the spar swings upwardly away from that position.

When a heavy load is being lifted, the reaction to the hoisting force, imposed upon the forwardly inclined boom 7, swings the boom in the forward-downward direction about its pivotal connection 10 with the platform. Through the tension connection 19 this swinging of the boom swings the spar upward, so that it lifts the auxiliary counterweight 20. The weight of the auxiliary counterweight then imposes upon the boom, through the tension connection 19, a force which offsets to a substantial extent the tilting force that the load imposes upon the boom.

To supplement the main counterweight 23 in counterbalancing the tilting force due to the boom itself, while at the same time achieving a desirable compactness of the crane structure, the winch 11 to which the load line 12 is connected, and the motor whereby that winch is driven, are both mounted in the girder-like structure of the spar 14, being located as far as possible to the rear of the pivotal connection 15 between the spar and the platform.

The link 18 is an elongated rod-like element that has at one of its ends a pivotal connection 24 to the platform and has at its other end a pivotal connection 25 to the spar. Both of these connections 24, 25 are spaced from the spar connection 15, and each of them defines a horizontal pivot axis which is parallel to the horizontal axes defined by the boom connection 10 and by the spar connection 15. Desirably the spar connection 15 is at the lowest practicable level on the platform to provide the maximum projected distance between that connection and a line through the connections 24, 25, thus keeping compressive stress on the link 18 to the lowest possible value. In this case the connection 24 between the link and the platform is located at a distance behind the boom connection 10 and substantially above the levels of the boom connection and the spar connection 15. One of the two link connections 24, 25—in this case the connection 25 of the link to the spar—is a pin-and-slot connection that permits limited relative movement between the link and the member (in this case spar 14) to which it is connected. Thus the connection 25 comprises a lengthwise extending slot 27 in the link and a pin 28 that is fixed in the spar and is both rotatable and lengthwise slidable in the slot 27. The engagement of the pin 28 against the ends of the slot 27 defines the limits of vertical swinging motion of the spar 14.

Since the spar has substantial width as measured transversely to the plane in which it swings, the lost motion connection between the spar and the platform can comprise two identical links that are connected to opposite sides of the spar in parallel with one another.

Figure 8:
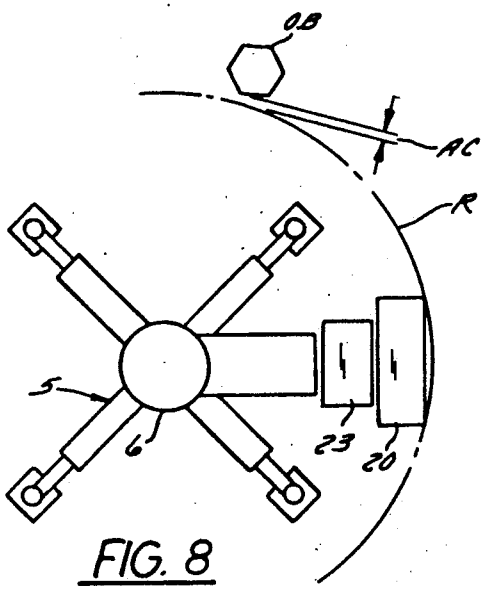
FIG. 8 is a practical schematic plan view of the crane and weights and illustrating the shorter radius of swing when the weights are raised to clear an obstruction on the ground.
Figure 3:
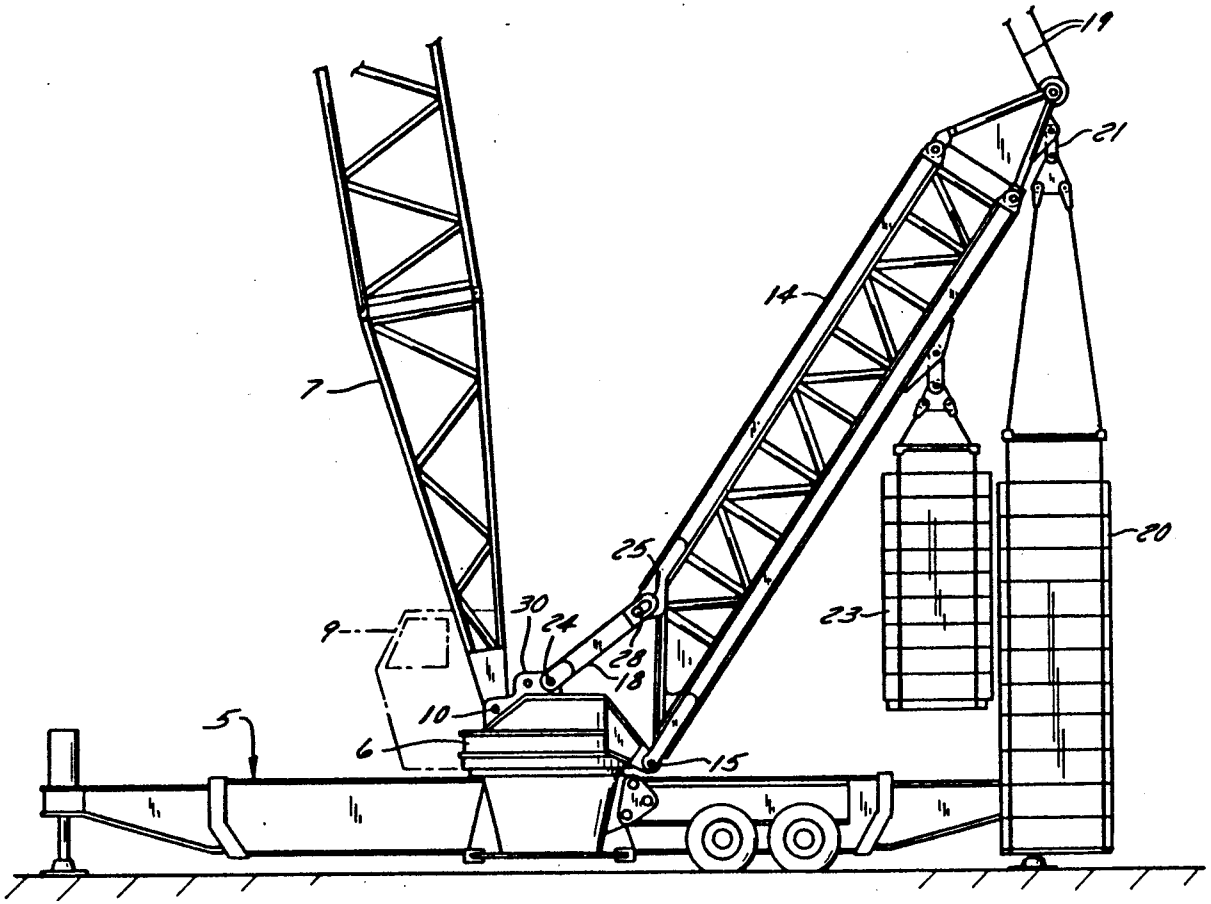
FIG. 3 is a view generally similar to FIG. 1 but on a larger scale and with the upper portion of the crane structure omitted.
Figure 4:
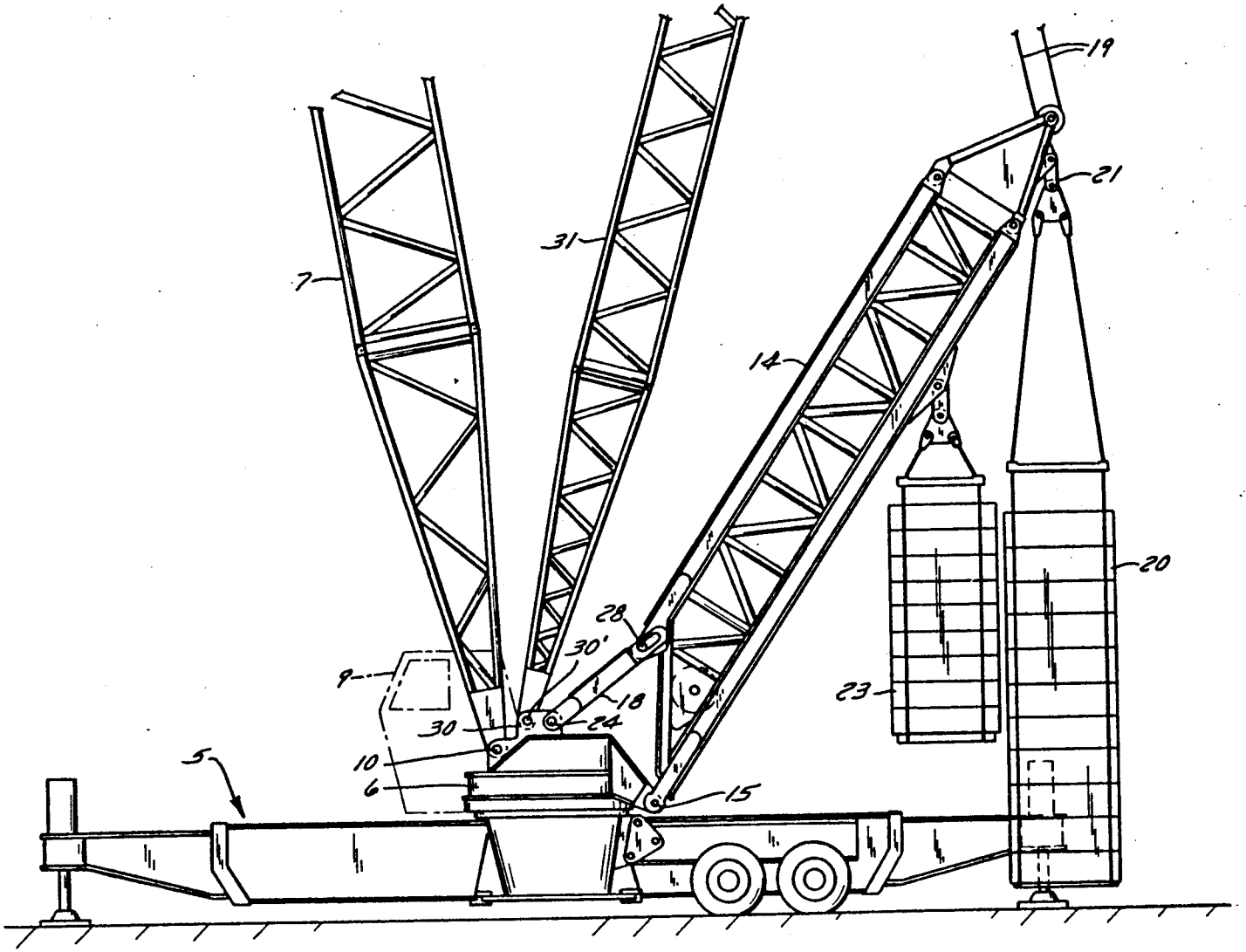
FIG. 4 is a view generally similar to FIG. 2 but on a larger scale and with the upper portion of the crane structure omitted.
Figure 5:
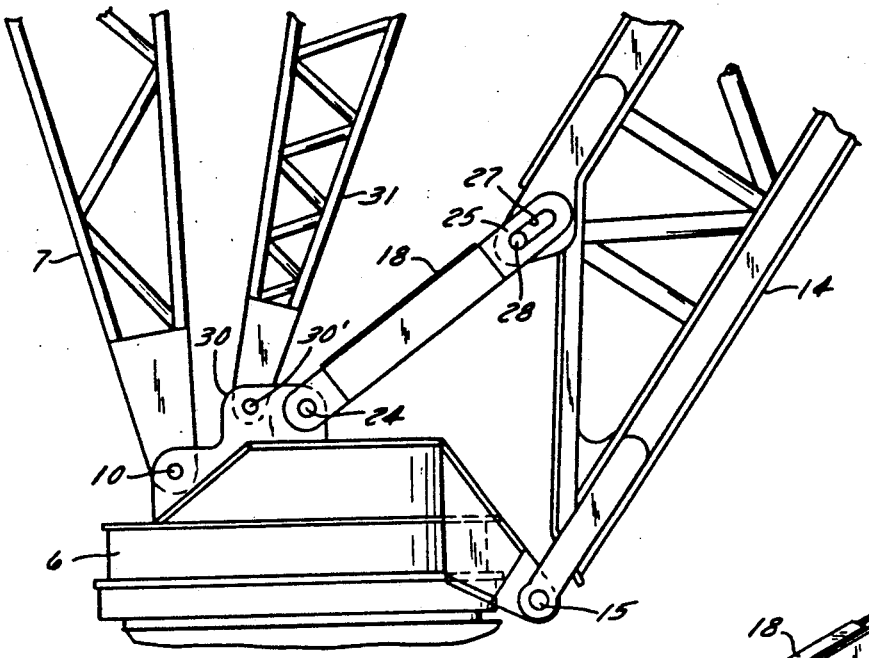
FIG. 5 is a fragmentary view on an enlarged scale of the crane of FIG. 2, showing its rotatable platform and the connections of the upper works to it, with the apparatus in the condition in which a heavy load is being hoisted and showing how the link limits upward motion of the spar.
Figure 7:
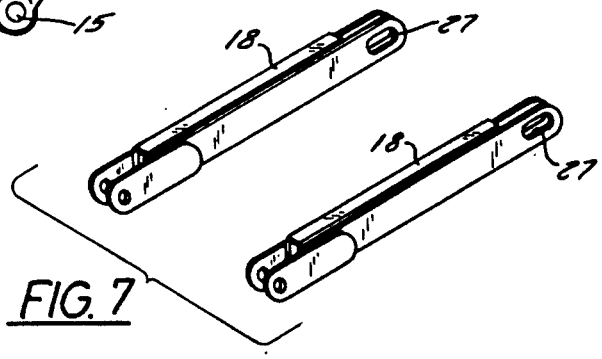
FIG. 7 is a perspective view of one embodiment of lost motion connection link for a crane of this invention.
Figure 6:
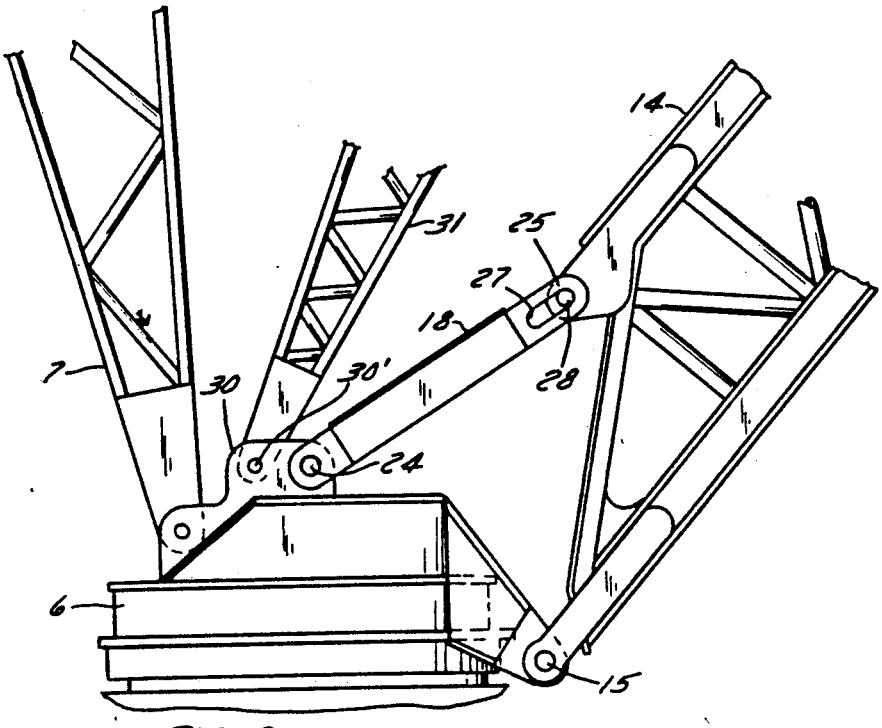
FIG. 6 is a view generally similar to FIG. 5 but showing the apparatus in its unloaded condition and how the link limits downward motion of the spar.

To meet special requirements for particular jobs, a crane embodying the principles of this invention may be provided with two or more spars of different lengths that are interchangeable with one another, or can be provided with a spar that can be lengthened by means of an insert or inserts, the longer spar or spars being useful for heavy loads at greater radii relative to the vertical axis. In like manner, the crane may be provided with two or more interchangeable links, to define different ranges of vertical swinging motion of a spar or to cooperate with different spar lengths. Where the crane must operate in a congested space, with an obstacle OB (FIG. 8) requiring additional clearance AC, so that tail swing must be kept as small as possible, a spar and link combination can be selected that will provide the smallest possible radius R (FIG. 8) of swing of the rear end of the spar about the vertical axis while at the same time providing the auxiliary counterweight with a lever arm that is adequate to offset the tilting forces that are to be imposed upon the boom.

Preferably there is a connection fixture 30 on the platform that provides for optional installation of a mast 31 that may be desirable under certain circumstances, particularly where a load to be lifted will impose stresses upon the boom that can be reduced by means of the mast. The mast connection 30 is located between the boom connection 10 and the connection 24 between the link 18 and the platform. When a mast 31 is installed, the connection 30' between its bottom end and the fixture 30 defines a horizontal swinging axis for the mast that is parallel to the axes about which the boom and the spar are swingable, and the mast swings in the same plane that contains the swinging of the boom and the spar.

A tension line **19*a* is connected between the upper ends of the boom and the mast, and another tension line 19*b* is connected between the upper end of the mast and the rear end of the spar. The tension lines 19*a* and 19*b*** are so adjusted as to length as to maintain the mast at an upward and rearward inclination to the vertical axis through the range of swinging motion of the spar, while also maintaining the boom at an upward and rearward inclination to the vertical axis.

From the foregoing description taken with the accompanying drawings it will be apparent that this invention provides a very compact but very versatile mobile crane that is easily transported, is easily assembled and disassembled for conversion between its operating and transport conditions, and is capable of hoisting very heavy loads while nevertheless having a small tail swing that makes it convenient to use in confined spaces.

What is claimed is:

1. A crane for lifting heavy loads, comprising a platform rotatable on a base about a vertical axis, an elongated boom having upper and lower ends, a boom connection between the platform and the boom, at the lower end of the latter, confining the boom to swinging relative to the platform substantially in a plane containing said vertical axis, and a load line trained over the upper end of the boom and having one end connected to a winch and an opposite free end portion connectable with a load to be lifted, said crane being characterized by:

A. an elongated spar having opposite front and rear ends, said spar
   (1) being substantially shorter than said boom and
   (2) having at its front end a spar connection with the platform
      (a) which is spaced in a rearward direction along the platform from said boom connection and
      (b) whereby the spar is confined to swinging motion substantially in said plane relative to the platform;

B. means providing a lost motion connection between the platform and the spar whereby the spar is confined to a range of swinging motion between opposite upper and lower limits and through which the rear end of the spar projects beyond the platform in said rearward direction;

C. a counterweight so connected to the rear end of the spar as to be supported by the ground when the spar is at the lower limit of its swinging motion but to be otherwise pendent from the spar and supported by it; and D. a tension connection between the upper end of the boom and the rear end of the spar whereby a constant distance is maintained between those ends, said distance being such that, throughout said range of swinging motion of the spar, the boom is maintained at a forward and upward inclination to said vertical axis.

2. The crane of claim 1, further characterized in that said means providing a lost motion connection between the platform and the spar comprises:

a rigid elongated link (1) having at one of its ends a pivotal connection with the platform that is spaced from said spar connection, (2) having at its opposite end a pivotal connection with the spar that is also spaced from said spar connection, (a) both of said pivotal connections defining horizontal swinging axes which are parallel to an axis defined by said spar connection, and (b) one of said pivotal connections being a pin-and-slot connection.

3. The crane of claim 2, further characterized by:

(1) said spar connection being at a substantially lower level than said boom connection, and (2) said pivotal connection of the link to the platform being (a) spaced rearwardly from said boom connection, (b) spaced forwardly from said spar connection, and (c) at a level substantially above the levels of said boom and spar connections.

4. The crane of claim 2, further characterized by:

E. means on said platform, between said boom connection and said spar connection, providing for connection to the platform of a mast which projects up from the platform and which has an upper end that is connected, respectively, to the upper end of the boom and to the rear end of the spar for swinging in unison with the boom and the mast.

5. The crane of claim 1, further characterized in that said winch is mounted on said spar, in spaced relation to said spar connection.

6. A crane for lifting heavy loads, of the type comprising a base, a platform supported on the base for rotation about a vertical axis, an elongated generally upright boom having at a lower end thereof a boom connection with the platform that defines a horizontal axis about which the boom is swingable relative to the platform substantially in a plane containing said vertical axis, and a load line trained over the upper end of the boom and having one end connected with a winch and an opposite free end portion connectable with a load, said crane being characterized by:

A. an elongated spar having front and rear ends, said spar (1) being substantially shorter than said boom and (2) having at its front end a spar connection with the platform (a) which is spaced in a rearward direction along the platform from said boom connection and (b) whereby the spar is confined to swinging motion substantially in said plane relative to the platform;

B. a rigid, elongated link (1) having at one of its ends a pivotal connection with the platform that is spaced from said spar connection and (2) having at its other end a pivotal connection with the spar that is spaced from said spar connection, (a) each of said pivotal connections defining an axis which is parallel to said horizontal axis and about which the link is relatively swingable and (b) one of said pivotal connections comprising a pin received in a lengthwise elongated slot in the link that defines upper and lower limits of a range of swinging motion of the spar wherein it extends from said spar connection at upward and rearward inclinations;

C. a tension connection between the upper end of the boom and the rear end of the spar whereby a constant distance is maintained between those ends, said distance being such that, throughout said range of swinging motion of the spar, the boom is maintained at a forward and upward inclination; and D. means on the rear end of the spar for connecting thereto a counterweight which is supported by the ground when the spar is at the lower limit of its swinging motion but which is otherwise pendently supported by the spar.

7. The crane of claim 6 further characterized by:

E. said winch being mounted on the spar in rearwardly spaced relation to said spar connection.

* * * * *